US012465832B2

(12) United States Patent
Finau et al.

(10) Patent No.: US 12,465,832 B2
(45) Date of Patent: Nov. 11, 2025

(54) GOLF SWING TRAINING APPARATUS

(71) Applicant: PRO SWING, LLC, Centerville, UT (US)

(72) Inventors: Kelepi Finau, Pleasant Grove, UT (US); Elone Fonua, Pleasant Grove, UT (US); Preston Ray Ward, Centerville, UT (US); Todd Jensen, Frisco, TX (US)

( * ) Notice: Subject to any disclaimer, the term of this patent is extended or adjusted under 35 U.S.C. 154(b) by 647 days.

(21) Appl. No.: 17/730,139

(22) Filed: Apr. 26, 2022

(65) Prior Publication Data

US 2022/0339515 A1 Oct. 27, 2022

Related U.S. Application Data

(60) Provisional application No. 63/180,070, filed on Apr. 26, 2021.

(51) Int. Cl.
*A63B 69/36* (2006.01)
*A63B 69/00* (2006.01)

(52) U.S. Cl.
CPC ..... *A63B 69/0057* (2013.01); *A63B 69/3621* (2020.08); *A63B 2225/09* (2013.01)

(58) Field of Classification Search
CPC ..... A63B 69/0057; A63B 69/3621; A63B 2225/09
See application file for complete search history.

(56) References Cited

U.S. PATENT DOCUMENTS

| | | | | | |
|---|---|---|---|---|---|
| 2,737,432 | A * | 3/1956 | Jenks | A63B 69/36213 | 473/211 |
| 2,807,472 | A * | 9/1957 | Hatfield | A63B 69/3621 | 473/259 |
| 5,308,074 | A | 5/1994 | Dorotinsky | | |
| 5,441,275 | A | 8/1995 | Yoshishita | | |
| 5,467,993 | A * | 11/1995 | Higginson | A63B 69/36211 | 473/259 |
| 5,538,251 | A | 7/1996 | Harper | | |
| 6,273,826 | B1 | 8/2001 | Bauer | | |
| 6,988,957 | B2 | 1/2006 | Bender | | |
| 2003/0176227 | A1 * | 9/2003 | Czaja | A63B 69/36212 | 473/277 |
| 2005/0202896 | A1 * | 9/2005 | Burke | A63B 69/0059 | 473/276 |
| 2007/0054785 | A1 * | 3/2007 | Drechsler | A63B 21/156 | 482/94 |
| 2007/0072694 | A1 * | 3/2007 | Meneghini | A63B 69/36213 | 473/259 |
| 2022/0339515 | A1 * | 10/2022 | Finau | A63B 69/36213 | |

FOREIGN PATENT DOCUMENTS

GB 2602545 A * 7/2022 ..... A63B 69/0057

* cited by examiner

*Primary Examiner* — Raleigh W Chiu

(57) ABSTRACT

Embodiments may include a golf swing training apparatus. The golf swing training apparatus may include a mount operable to couple with a fixed object. The golf swing training apparatus may include a mounting collar operable to couple with the mount. The golf swing training apparatus may include an arm operable to be pivotally coupled with the mounting collar. The golf swing training apparatus may include a clamp pivotally coupled with the arm, wherein the clamp is operable to be clamped about a shaft.

18 Claims, 14 Drawing Sheets

GOLF SWING TRAINING APPARATUS

CROSS-REFERENCE TO RELATED APPLICATIONS

This application claims the benefit of U.S. Provisional Patent Application 63/180,070 filed Apr. 26, 2021, which is incorporated herein in its entirety by reference.

BACKGROUND

Golf is a sport enjoyed by many. Golf is difficult to master and requires many hours playing and/or practicing to become proficient. Many methods and apparatuses have been used to help train individuals in the sport. Many current machines are cumbersome, and many current methods are time consuming.

SUMMARY

Embodiments of the invention include a golf swing training apparatus. The golf swing training apparatus may comprise a mount operable to be coupled with a fixed object. The mount may comprise a front section and a rear section, wherein the front section may comprise a first side and a second side. The first side may comprise at least one notch. The golf swing training apparatus may comprise a mounting collar operable to be slidably coupled with the mount. The mounting collar may comprise an outer side comprising a first pivoting member. The mounting collar may comprise an inner side comprising a channel operable to slidably couple with the front section. The mounting collar may comprise at least one lever pivotally coupled with the first side, the at least one lever comprising a first protrusion operable to detachably engage with the at least one notch. The mounting collar may comprise a first pivot member on the outer side. The golf swing training apparatus may comprise a second pivot member operable to be pivotally coupled with the first pivot member. The golf swing training apparatus may comprise a tube coupled with the second pivot member, the tube comprising a cap detachably coupled to tube opposite the second pivot member, the cap comprising at least one opening. The golf swing training apparatus may comprise a rod comprising a first end and a second end, the rod being telescopically coupled with the tube at the first end, the first end passing through the at least one opening. The golf swing training apparatus may comprise a pivoting connection coupled with the second end of the rod. The golf swing training apparatus may comprise a collar coupled to the pivoting connection, the collar comprising a stator and a rotator coupled to the stator, the collar being operable to detachably couple about a shaft.

Some embodiments may include a golf swing training apparatus. The golf swing training apparatus may include a mount operable to couple with a fixed object. The golf swing training apparatus may include a mounting collar operable to couple with the mount. The golf swing training apparatus may include an arm operable to be pivotally coupled with the mounting collar. The golf swing training apparatus may include a clamp pivotally coupled with the arm, wherein the clamp is operable to be clamped about a shaft.

Embodiments discussed herein allow users to quickly and easily practice swinging a golf club in a controlled and convenient manner. The designs described herein controls a user's golf swing, from putting to driving, such that the swing is in proper form, leading to the most efficient swing and the best results while golfing. Repetitive practice with the designs described herein may help a user to build muscle memory for the proper swing, may assist in correcting a swing that is "out", and/or may help a user to prime their swing prior to hitting golf balls.

The various embodiments described in the summary and this document are provided not to limit or define the disclosure or the scope of the claims.

DETAILED DESCRIPTION

Figure 1:
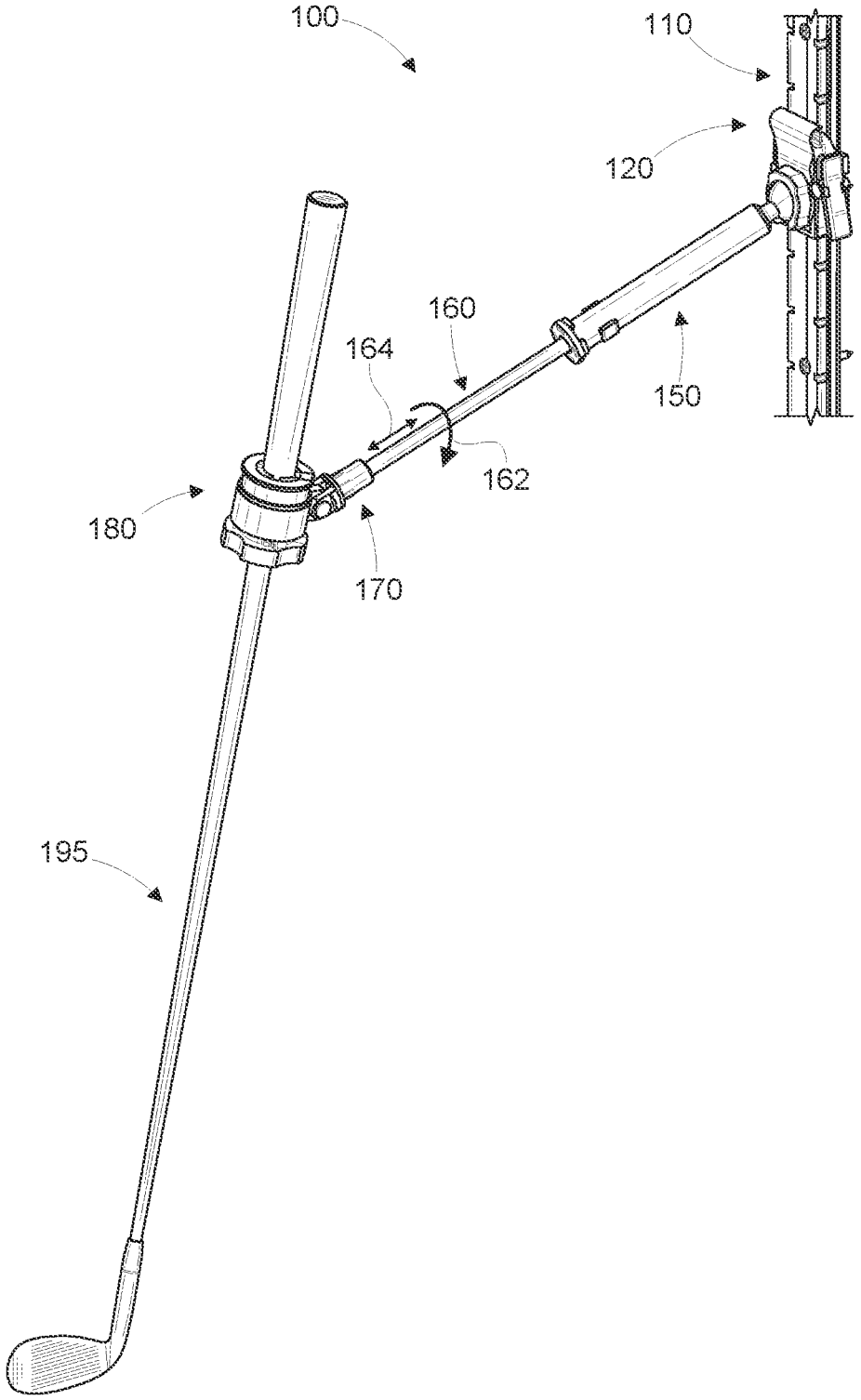
FIG. 1 is an illustration of an embodiment of a golf swing training apparatus.
Figure 2A:
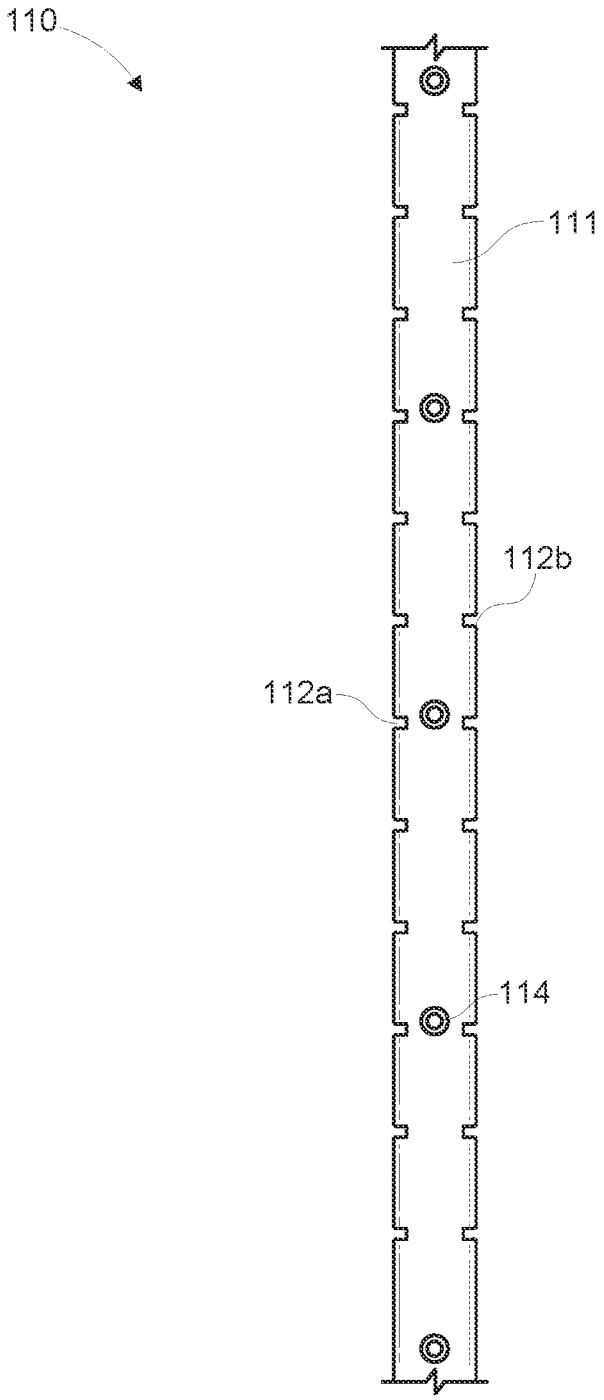
FIG. 2A is an illustration of an embodiment of an aspect of a golf swing training apparatus.
Figure 2B:
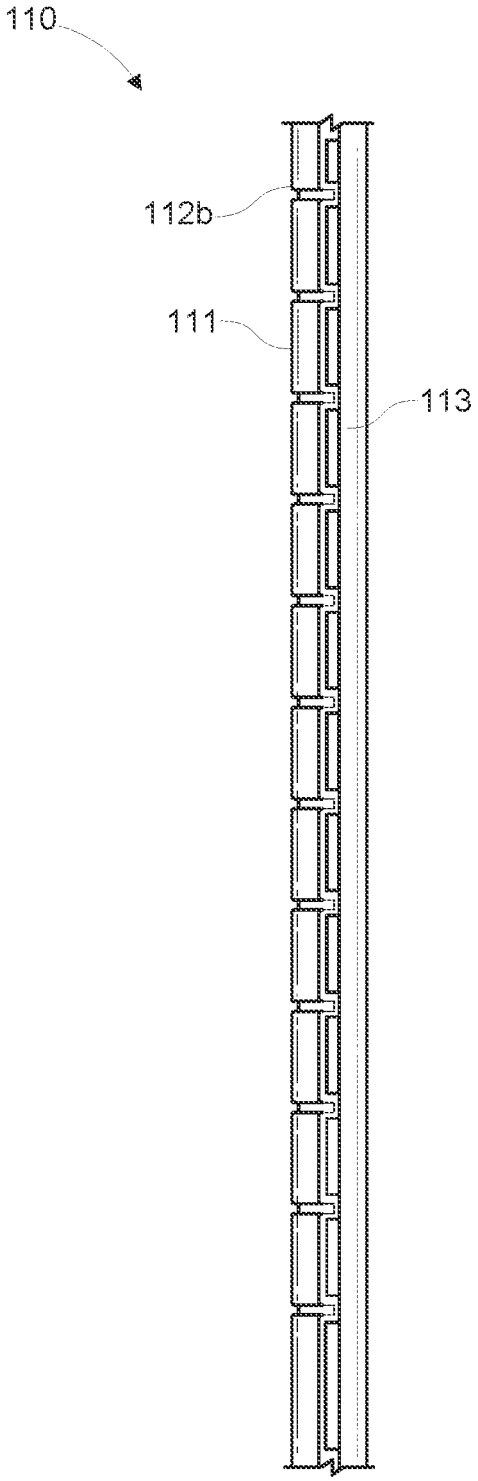
FIG. 2B is an illustration of an embodiment of an aspect of a golf swing training apparatus.

Some embodiments include a golf swing training system 100, as shown in FIG. 1. The golf swing training system 100 may include various unique components. Some embodiments may include a mount 110. The mount 110 may comprise a shaft, a rod, a bar, or similar apparatus, as shown in FIGS. 2A and 2B. Referring now to FIGS. 2A and 2B, the mount 110 may comprise a front section 111. The front section 111 may be coupled to a rear section 113. The front section 111 and the rear section 113 may comprise a solid one-piece construction or may comprise multiple pieces.

Figure 2C:
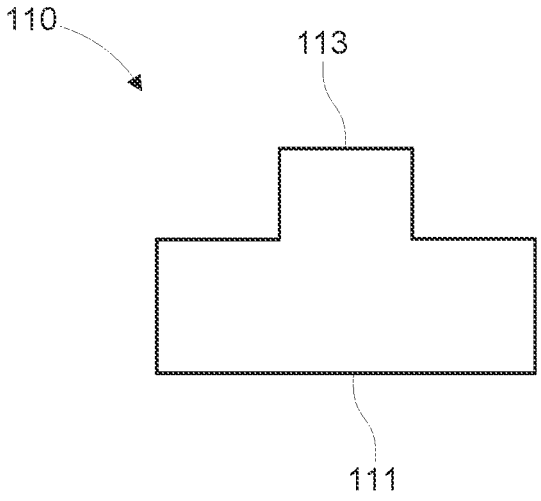
FIG. 2C is an illustration of an embodiment of an aspect of a golf swing training apparatus.

Some embodiments may include the front section 111 being wider than the rear section 113. As shown in FIG. 2C, which is a cross-sectional overhead view of the mount 110, the rear section 113 may be centered on the front section 111.

The mount 110 may comprise at least a first notch 112*a*. The at least a first notch 112*a* may be positioned along a first edge of the front section 111. In some embodiments, the at least a first notch 112*a* may have a height of between 0.10 inches and 0.25 inches. The at least a first notch 112*a* may have a height of approximately 0.125 inches and a depth of approximately 0.125 inches.

Some embodiments may include the at least a first notch 112*a* comprising at least a second notch 112*b*. The at least a second notch 112*b* may be positioned directly opposite from the at least first notch 112*a* on a second edge opposite the first edge. In some embodiments, the at least a second notch 112*a* may have a height of between 0.10 inches and 0.25 inches. The at least a second notch 112*b* may have a height of approximately 0.125 inches and a depth of approximately 0.125 inches.

Some embodiments may include the at least a first notch 112*a* comprising a plurality of first notches 112*a* along the first edge. The at least a second notch 112*b* may comprise a plurality of second notches 112*b* along the opposing second edge. Each first notch 112*a* may be positioned directly opposite a respective second notch 112*b*. The spacing between adjacent first notches 112*a* may be approximately 1.5 inches, that is, the distance between at least one first notch 112*a* and an adjacent first notch 112*a*, may be approximately 1.5 inches. In some embodiments, the spacing between adjacent at least a first notches 112*a* may be between 0.5 inches and 2 inches. The spacing between adjacent at least second notches 112*b* may be the same as the spacing between the at least a first notches 112*a*.

Some embodiments of the mount 110 may comprise at least one mounting hole 114. The at least one mounting hole 114 may pass completely through the front section 111 and the rear section 113. The at least one mounting hole 114 may be centered on the front section 111 and the rear section 113. The at least one mounting hole 114 may be operable to accommodate a fastener, as will be discussed herein below. The at least one mounting hole 114 may comprise multiple mounting holes over the length of the mount 110.

In some embodiments, the mount 110 may be detachably coupled to a solid fixture, such as a wall, a post. The mount 110 may be coupled to a solid fixture, such as the wall via fasteners 116. Fasteners 116 may comprise a screw, a nail, a rivet, or other suitable fastener.

In some embodiments, the mount 110 may be detachably coupled to a mobile fixture, such as a golf cart or a vehicle, allowing a user to use the system 100 on the golf course.

Figure 3:
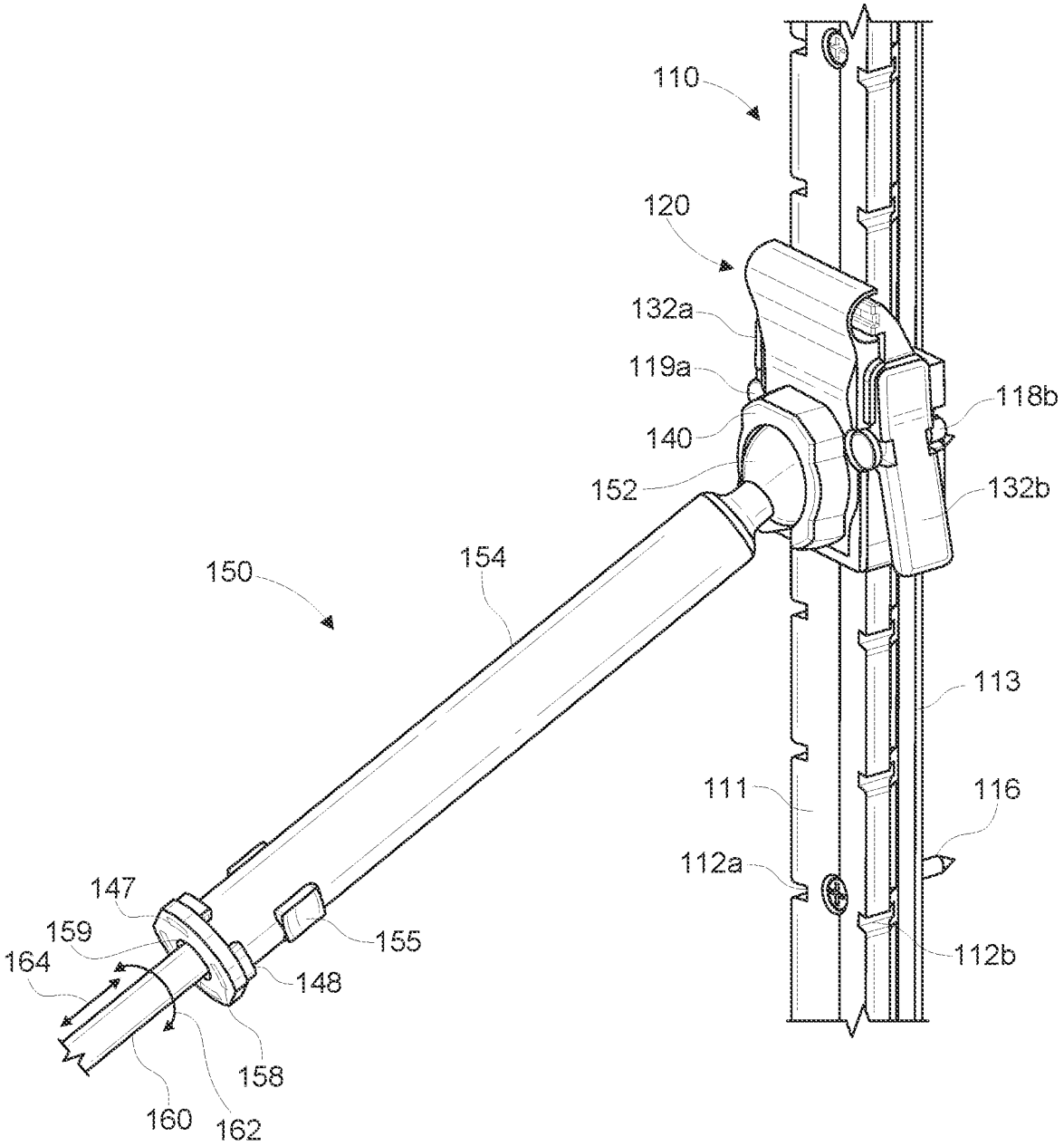
FIG. 3 is an illustration of an embodiment of various aspects of a golf swing training apparatus.
Figure 4A:
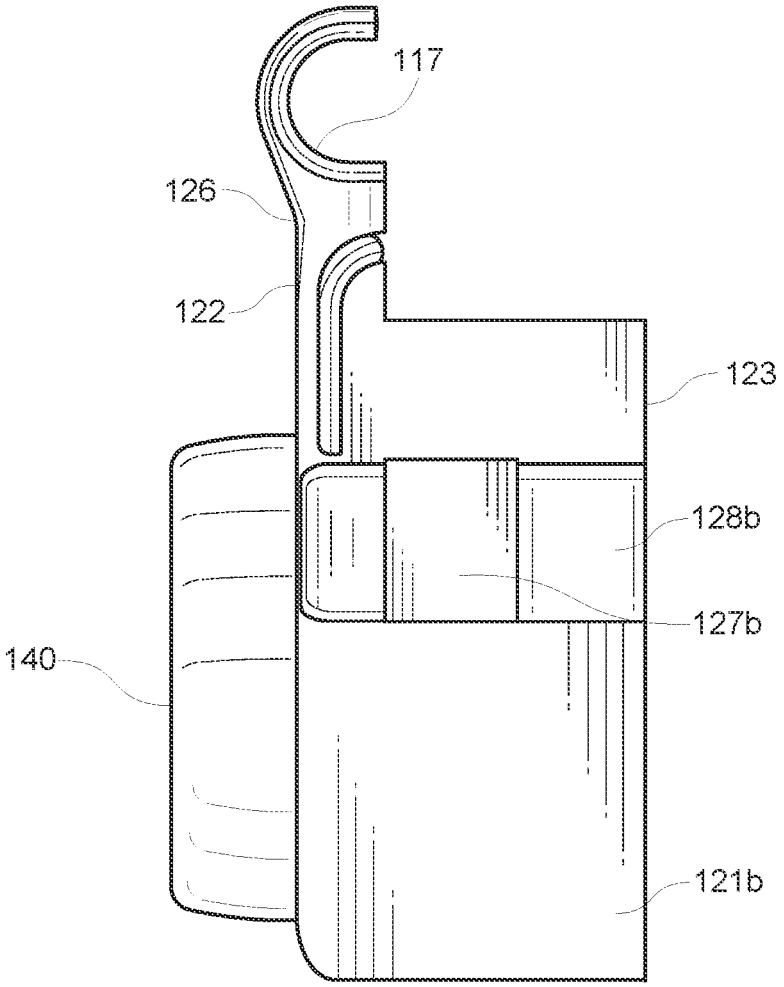
FIG. 4A is an illustration of an embodiment of an aspect of a golf swing training apparatus.

Referring now to FIG. 3, a portion of the system 100 is shown in greater detail. Some embodiments may comprise the system 100 further comprising a mounting collar 120. The mounting collar 120 may be slidably coupled with the mount 110. As shown in FIG. 4A, which illustrates a side view of the mounting collar 120, the mounting collar 120 may comprise an outer side 122 and an inner side 123.

Figure 4B:
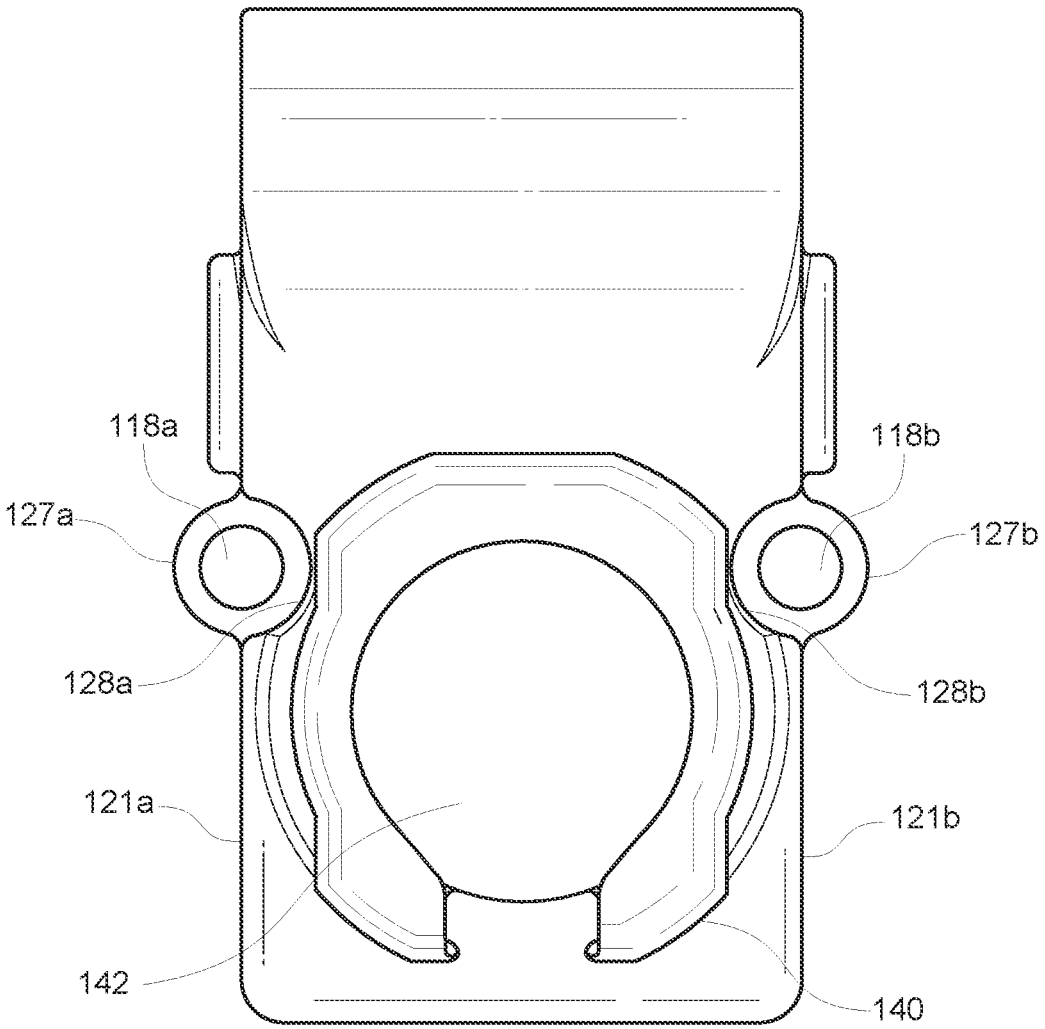
FIG. 4B is an illustration of an embodiment of an aspect of a golf swing training apparatus.

Referring to FIG. 4B, in some embodiments, the mounting collar 120 may further comprise a first side 121*a*. The mounting collar 120 may comprise a first pivot support 127*a* on the first side 121*a*. The mounting collar 120 may comprise a first pivot groove 128*a* on the first side 121*a*. The first pivot support 127*a* may be coupled around the first pivot groove 128*a* and may form a first opening 118*a*. Referring briefly to FIG. 3, the first opening 118*a* may be sized and configured to accommodate a first pivoting pin 119*a*.

In some embodiments, the mounting collar 120 may further comprise a second side 121*b*. The mounting collar 120 may comprise a second pivot support 127*b* on the second side 121*b*. The mounting collar 120 may comprise a second pivot groove 128*b* on the second side 121*b*. The second pivot support 127*b* may be coupled around the second pivot groove 128*b* and may form a second opening 118*b*. The second opening 118*b* may be sized and configured to accommodate a second pivoting pin 119*b*.

Figure 4C:
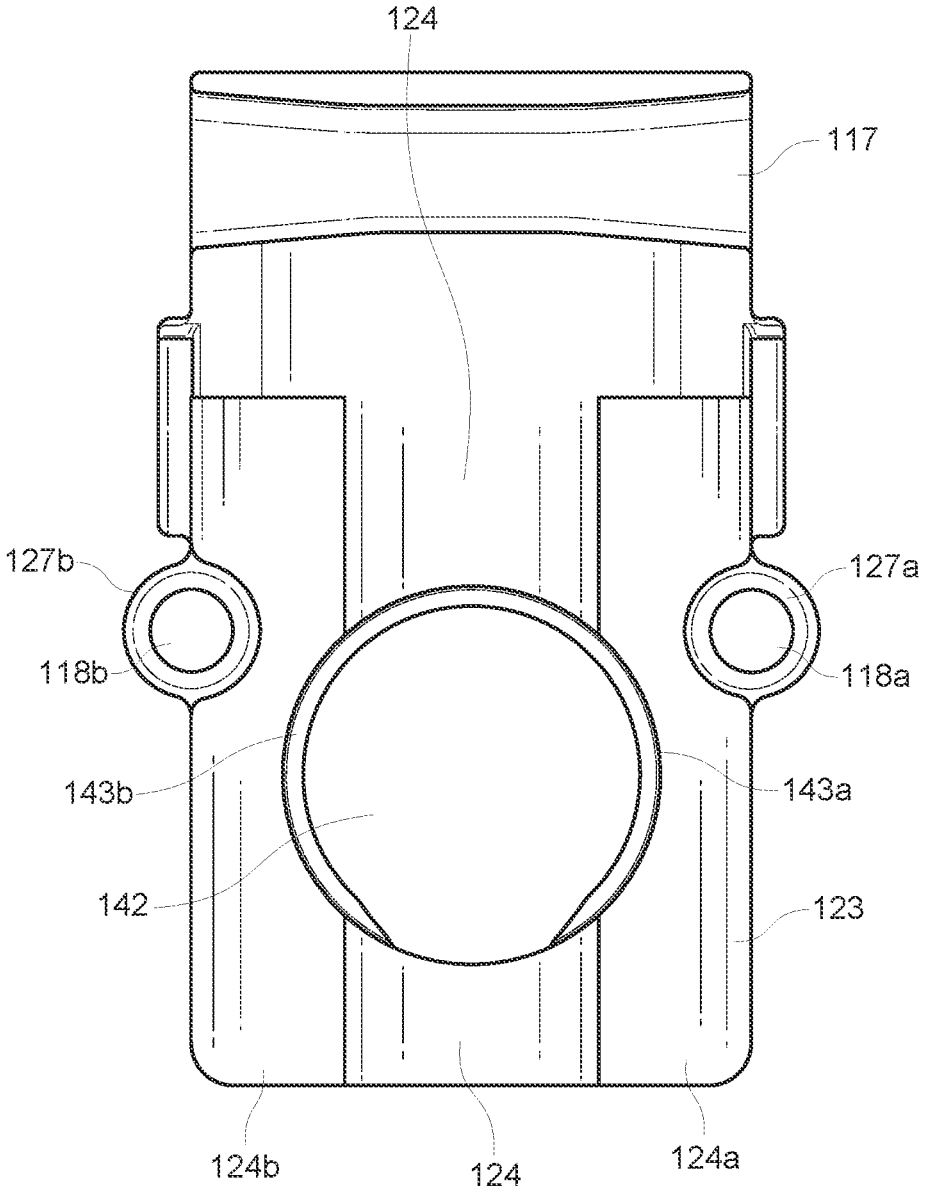
FIG. 4C is an illustration of an embodiment of an aspect of a golf swing training apparatus.

Referring now to FIG. 4C, which illustrates a rear view of the mounting collar 120, some embodiments may include the inner side 123 comprising a channel 124. The channel 124 may be sized and configured to slidably couple with the front section 111 of the mount 110. The channel 124 may be formed between a first wall 124*a* and a second wall 124*b*. The mounting collar 120 may slide about the front section 111 of the mount 110 and may be temporarily fixed at various locations along the mount 110, as will be described herein below.

Figure 5A:
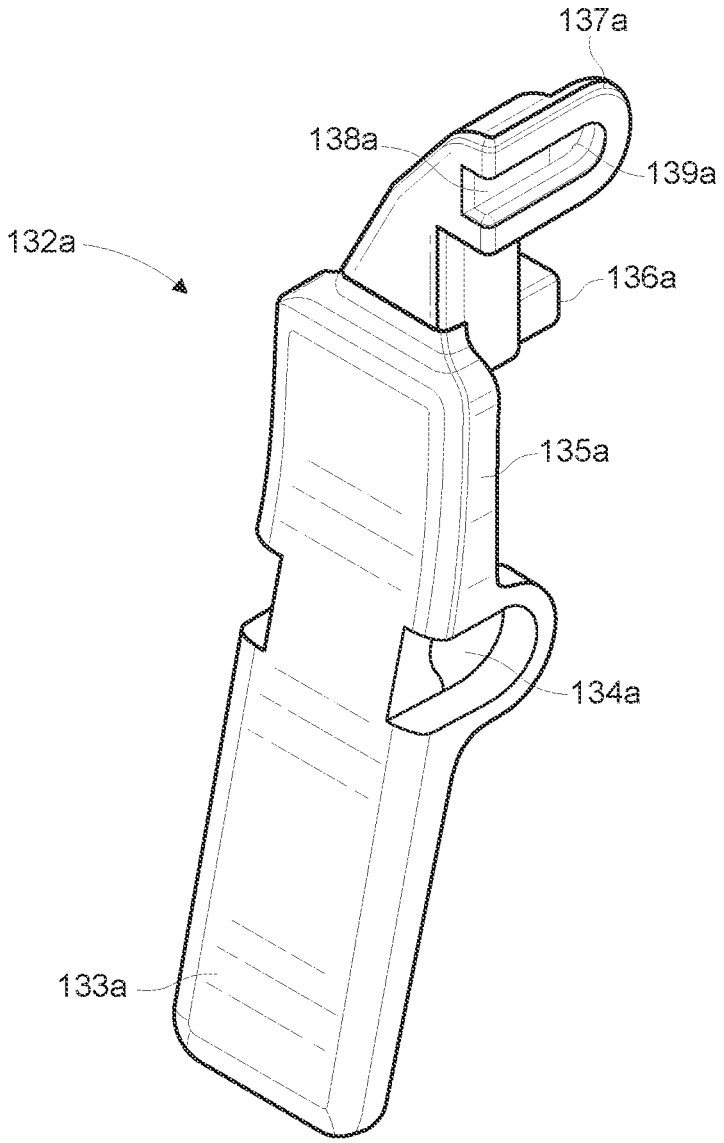
FIG. 5A is an illustration of an embodiment of an aspect of a golf swing training apparatus.
Figure 5B:
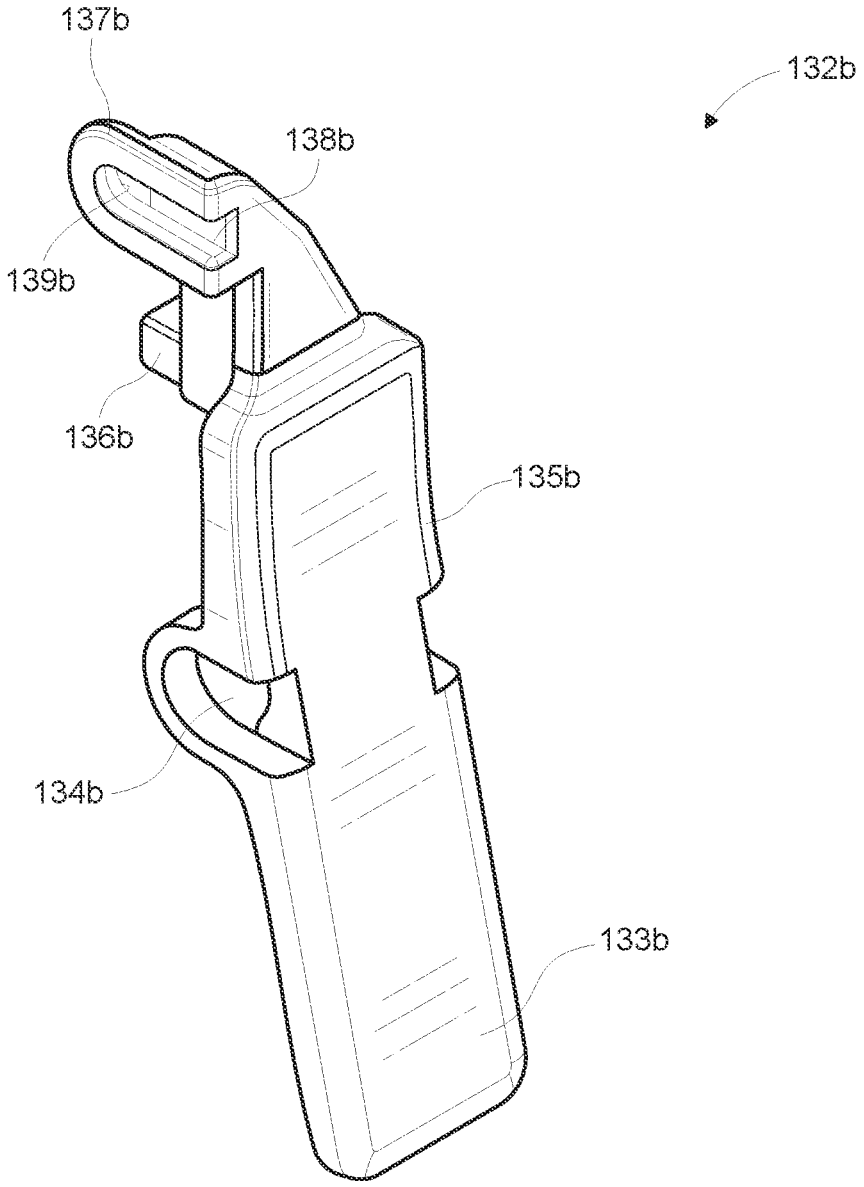
FIG. 5B is an illustration of an embodiment of an aspect of a golf swing training apparatus.
Figure 5C:
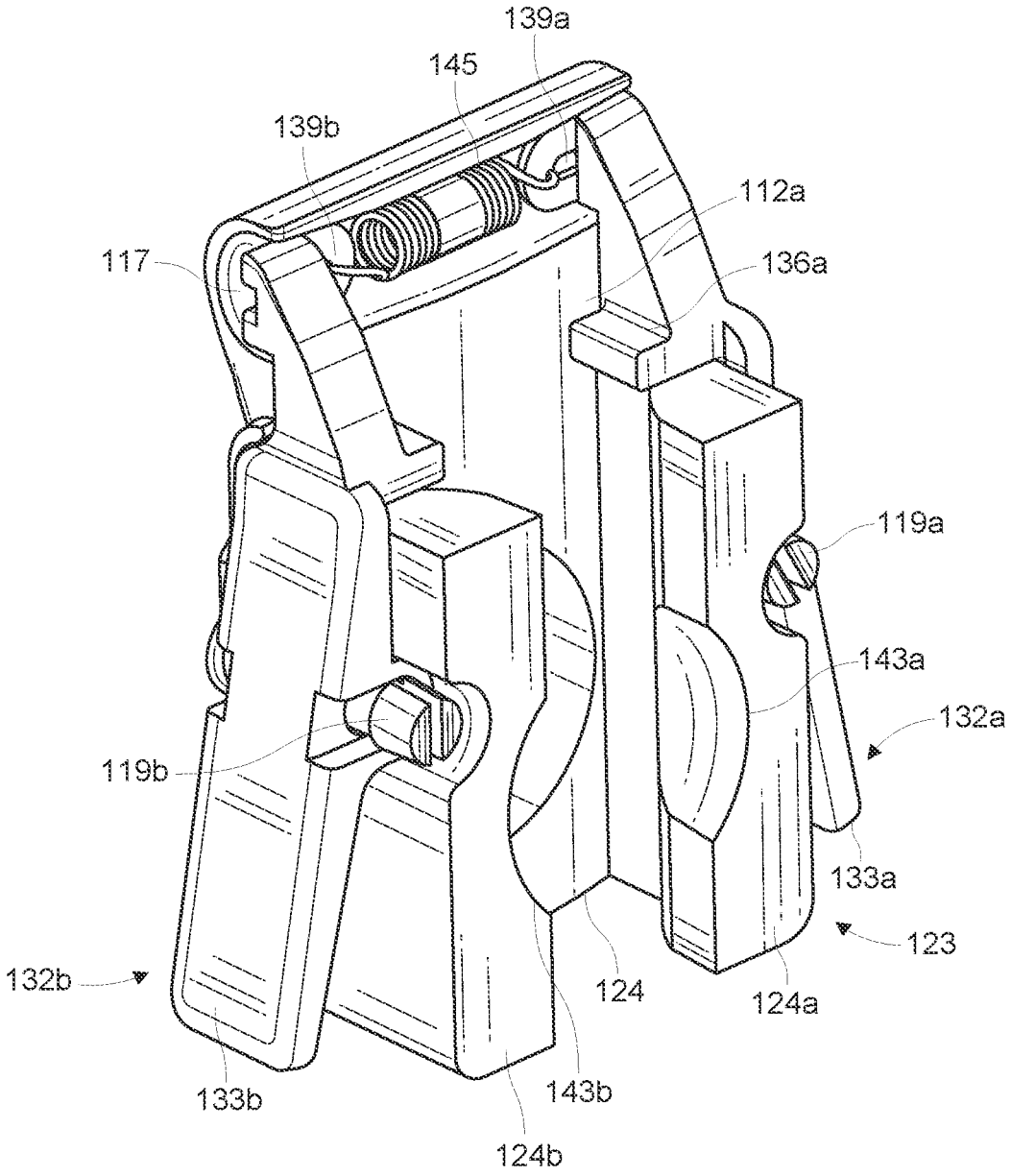
FIG. 5C is an illustration of an embodiment of an aspect of a golf swing training apparatus.

As shown in FIG. 4C and in FIG. 5C, the channel 124, and the respective first wall 124*a* and 124*b*, may comprise first cutout 143*a* and second cutout 143*b*. The first cutout 143*a* and the second cutout 143*b* may be sized and configured to accommodate a ball, as discussed below.

As shown in FIGS. 4A-4C, some embodiments may include the mounting collar 120 further comprising a neck 126 along the outer side 122 of the mounting collar 120. The mounting collar 120 may further comprise a coupling channel 117 coupled to the neck 126 of the mounting collar 120. The coupling channel 117 may be rounded in a semi-circular fashion.

In some embodiments, the mounting collar 120 may further comprise a first pivoting member, such as a socket 140. The socket 140 may extend from the outer side 122.

Referring again to FIG. 3, the mounting collar 120 may comprise a first lever 132*a*. The first lever 132*a* may be pivotally coupled to the first side 121*a* of the mounting collar 120 at the first opening 118*a*. Referring now to FIG. 5A, the first lever 132*a* may comprise a first pivot opening 134*a*. The first pivot opening 134*a* may be pivotally coupled with the mounting collar 120 at the first opening 118*a* by the first pivoting pin 119*a*, as shown in FIG. 3. The first pivot opening 134*a* may be sized and configured to rotate about first pivoting pin 119*a*. The first lever 132*a* may comprise a first pedal 133*a* below the fulcrum point created by the first pivot opening 134*a*. The first lever 132*a* may extend from the first pivot opening 134*a* at an angle such that the first lever 132*a* extends away from the mount 110 when the mounting collar 120 is slidably coupled thereto. The first pivoting member 133*a* may extend at an angle between five (5) degrees and thirty (30) degrees. In some embodiments the first pivoting member 133*a* may extend at an angle between ten (10) degrees and twenty (20) degrees. In some embodiments the first pivoting member 133*a* may extend at an angle of approximately fifteen (15) degrees.

The first lever 132*a* may further comprise a first connecting member 135*a* extending substantially vertically from the first pivot opening 134*a*. The first lever 132*a* may further comprise a first head area 131 coupled to the first connecting member 135*a*. The first lever 132*a* may further comprise a first protrusion 136*a* extending approximately normally to the first head area. The first protrusion 136*a* may be sized and configured to fit within the first notch 112*a* on the mount 110, thereby temporarily fixing the vertical location of the mounting collar 120 along the mount 110.

The first lever 132*a* may further comprise a first coupler 137*a*. The first coupler may comprise a first groove 138*a* and first eye 139*a*. The first coupler 137*a* may be sized and configured to fit within and engage with the coupling channel 117.

The first lever 132*a* may be supported in place such that the first protrusion 136*a* is held securely within the first notch 112*a* and the first coupler 137*a* is held within the coupling channel 117 by a biasing member, as discussed below.

Referring again to FIG. 3, in some embodiments, the mounting collar 120 may comprise a second lever 132*b*. The second lever 132*b* may be pivotally coupled to the second side 121*b* of the mounting collar 120 at the second opening 118*b*. Referring now to FIG. 5B, the second lever 132*b* may comprise a second pivot opening 134*b*. The second pivot opening 134*b* may be pivotally coupled with the mounting collar 120 at the second opening 118*b* by the second pivoting pin 119*b*, as shown in FIG. 3. The second pivot opening 134*b* may be sized and configured to rotate about second pivoting pin 119*b*. The second lever 132*b* may comprise a second pedal 133*b* below the fulcrum point created at the second pivot opening 134*b*. The second lever 132*b* may extend from the second pivot opening 134*b* at an angle such that the second lever 132*b* extends away from the mount 110 when the mounting collar 120 is slidably coupled thereto. The second pivoting member 133*b* may extend at an angle between five (5) degrees and thirty (30) degrees. In some embodiments the pivoting member 133*b* may extend at an angle between ten (10) degrees and twenty (20) degrees. In some embodiments the pivoting member 133*b* may extend at an angle of approximately fifteen (15) degrees.

The second lever 132*b* may further comprise a second connecting member 135*b* extending substantially vertically from the second pivot opening 134*b*. The second lever 132*b* may further comprise a second head area 131 coupled to the second connecting member 135*b*. The second lever 132*b* may further comprise a second protrusion 136*b* extending approximately normally to the second head area. The second protrusion 136*b* may be sized and configured to fit within the second notch 112*b* on the mount 110, thereby temporarily fixing the vertical location of the mounting collar 120 along the mount 110.

The second lever 132*a* may further comprise a second coupler 137*b*. The second coupler may comprise a second groove 138*b* and second eye 139*b*. The second coupler 137*b* may be sized and configured to fit within and engage with the coupling channel 117.

The second lever 132*b* may be supported in place such that the second protrusion 136*b* is held securely within the second notch 112*b* and the second coupler 137*b* is held within the coupling channel 117 by a biasing member, as discussed below.

Referring now to FIG. 5C, in some embodiments, the inside 123 of the mounting collar 120 is shown with the first lever 132*a* and the second lever 132*b* attached to the mounting collar 120, as described above. The first lever 132*a* and the second lever 132*b* may be operably and detachably coupled to each other via lever biasing member 145. The lever biasing member 145 may comprise a spring, compression spring, a coil spring, a helical coil spring, or other reciprocal resistance object. The biasing lever may be sized and configured to fit within the coupling channel 117. In some embodiments, the lever biasing member 145 may be configured to support only first lever 132*a*. In some embodiments, the lever biasing member 145 may be configured to support only the second lever 132*b*.

Upon applying pressure to the pedal 133*a* and to the pedal 133*b*, the first lever 132*a* and the second lever 132*b* may pivot about the pin 119*a* and the pin 119*b*, respectively. Upon pivoting about the respective pins the lever biasing member 145 may expand, providing resistance to the pedal 132*a* and the pedal 132*b*. The first coupler 137*a* and the second coupler 137*b* may move away from the center of the coupling channel 117. In some embodiments the first coupler 137*a* and the second coupler 137*b* may only partially be removed from the coupling channel 117. In some embodiments the first coupler 137*a* and the second coupler 137*b* may completely exit the coupling channel 117. When the first protrusion 136*a* and the second protrusion 136*b* are disengaged from the first notch 112*a* and the second notch 112*b*, respectively, the mounting collar 120 may be moved to various positions along the mount 110. Upon releasing the pressure from pedal 133*a* and the pedal 133*b*, the resistance from the lever biasing member 145 may pull the first coupler 137*a* and the second coupler 137*b* toward the center of the coupling channel 117.

Figure 6:
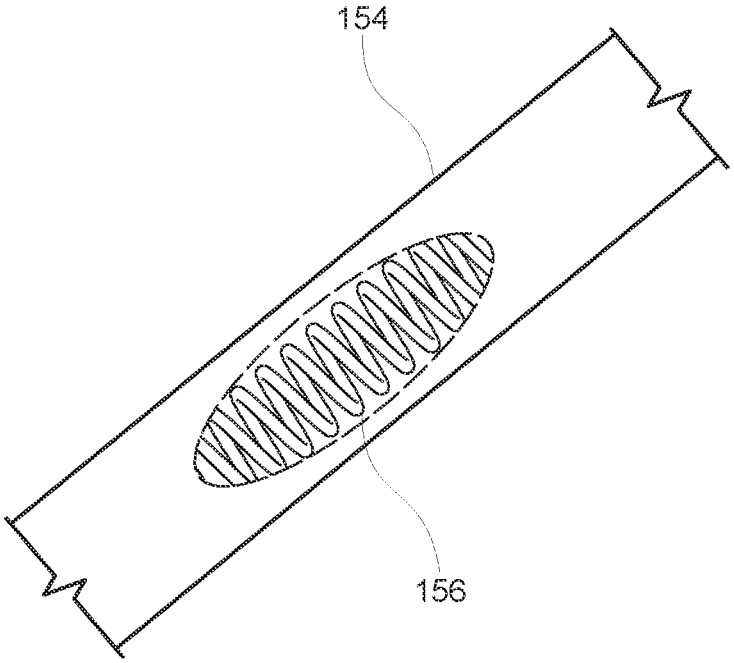
FIG. 6 is an illustration of an embodiment of an aspect of a golf swing training apparatus.

Referring again to FIG. 3 and to FIG. 6, the system 100 may further comprise an arm 150. The arm 150 may comprise a coupling pivoting member, such as a ball 152. The ball 152 may be sized and configured to fit within the socket 140 but is sized and configured such that the ball 152 cannot pass through the socket 140. The ball may be held securely within the socket 140 by the mount 110. The ball 152 may rotate fully within the socket 140. The arm 150 may be sized and configured to fit within the socket 140, such that the arm 150 may pass through the socket 140, being stopped by the ball 152.

The ball 152, and other components attached to the ball may rotate in any direction within the socket 140. The ball 152 may rotate in the x, y, and z planes, providing a full range of motion. The ball 152 may have only the space to minimally move or translate linearly in or out of the socket 140 when the mounting collar 120 is mounted on the mount 110. The ball 152 may be sized and configured to rotate in all directions freely within the socket 140.

The arm 150 may comprise a first member, such as a cylinder 154. The cylinder 154 may extend from the ball 152. The cylinder 154 may be made from a ridged material. The cylinder 154 may have a hollow center, as illustrated in FIG. 6. The cylinder 154 may comprise a tube. The hollow center of the cylinder 154 may be operable to accommodate a biasing member 156, as discussed herein below. The biasing member 156 may comprise a spring, a compression spring, a coil spring, a helical coil spring, or other reciprocal resistance object. The biasing member 156 may comprise a resting length between ten percent (5%) and ninety (95%) of the length of cylinder 154. In some embodiments, the resting length of the spring may comprise between twenty-five percent (25%) and seventy-five percent (75%) of the length of the cylinder 154. In some embodiments, the compressed length of the biasing member 156 may be between one percent (1%) and ninety percent (90%) of the length of the cylinder 154. In some embodiments, the compressed length of the biasing member 156 may be between ten percent (10%) and eighty percent (80%) of the length of the cylinder 154. In some embodiments, the compressed length of the biasing member 156 may be between twenty-five percent (25%) and seventy-five percent (75%) of the length of the cylinder 154. The biasing member 156 may have a diameter less than that of the cylinder 154. The spring constant of the biasing member 156 may be sufficient to push against an elongated member coupled with a golf club when in use, such that the elongated member is pushed out of the cylinder 154, as discussed below.

In some embodiments, the arm 150 may further comprise a cap 158. The cap 158 may be placed on the cylinder 154, on an end opposite and distal from the ball 152. The cap 158 may be detachably coupled to the cylinder 154. In some embodiments the cap 158 may be coupled with or decoupled from the cylinder 154 by twisting the cap 158 on and off. The cap 158 may comprise risers 148. The risers 148 may couple with the end of the cylinder 154 by twisting to lock or unlock. The risers 148 may be threadably coupled with the cylinder 154. The cylinder 154 may comprise tabs 155 to aid in fastening or removing the cap 158. The connection between the cap 158 and the cylinder 155 may be a very strong connection. A wrench may be used with the tabs 155 to aid in securing the cap 158 to the cylinder 154 and in removing the cap 158 from the cylinder 154. The cap 158 may further comprise at least one vent 147. The at least one vent 147 may allow air to pass therethrough when objects enter or exit the cylinder 154. The cap 158 may further comprise an opening 159.

Referring again to FIG. 1 and FIG. 6, in some embodiments, the arm 150 may comprise a second member, such as an elongated member 160. The elongated member 160 may comprise a rod. The elongated member may comprise a rigid material. The elongated member may comprise a first end and a second end. The elongated member 160 may be rotatably coupled with cap 158 and may fit within the opening 159. The elongated member 160 may be rotatably fixed within the cap 158, such that the elongated member 160 may rotate about its longitudinal axis, as indicated by the arrow 162. The elongated member 160 may comprise an end, such as the first end, that is larger than the opening 159, preventing the elongated member from escaping the cap 158.

The opening 159 may be sized and configured to allow the elongated member 160 to rotate as shown by arrow 162 and to translate, as shown by arrow 164. The first end of the elongated member 160 may engage with the biasing member 156, such that the biasing member 156 may compress as the elongated member 160 translates (as shown by the arrow 164) into the cylinder 156. The biasing member 156 may decompress, pushing the elongated member 160 away from the ball 152 within the cylinder 156, translating in the opposite direction (as shown by arrow 164). In this way, the biasing member 154 may be operable to dynamically adjust the distance between the ball 152 and an opposite end of the elongated member 160, and the attachments thereto, as will be discussed.

Figure 7:
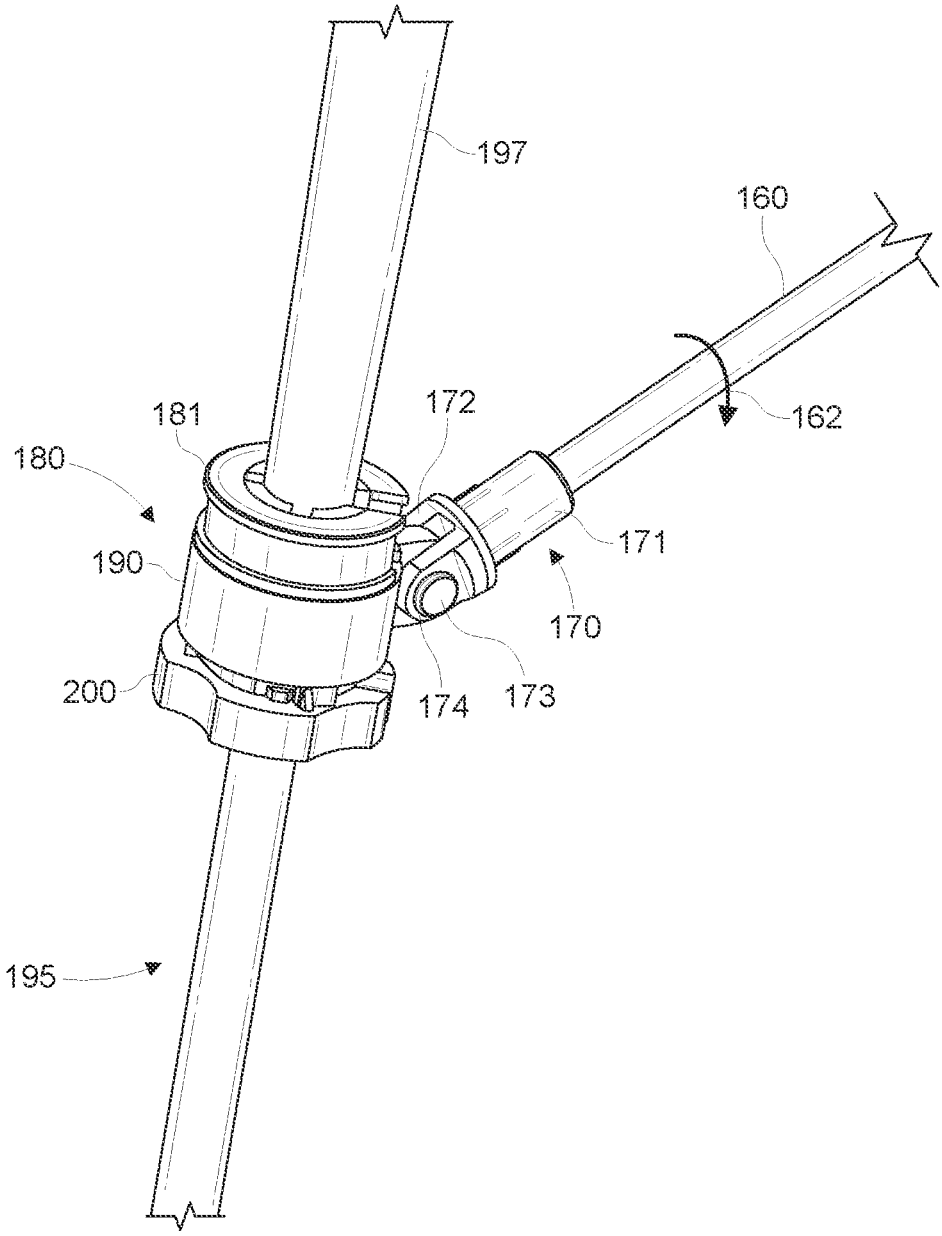
FIG. 7 is an illustration of an embodiment of an aspect of a golf swing training apparatus.

Referring now to FIG. 7, the elongated member 160 is shown at the second end of the elongated member, that is, an end opposite the interface with the biasing member 154. The elongated member 160 may be operably coupled to a connection member 170 at a stator 171. Similar to the connection with the cap 158, the elongated member 160 may be rotationally coupled to the connection member 170. In some embodiments, the elongated member 160 may rotate within the stator 171 but may not exit stator 171. In some embodiments, the elongated member 160 may not rotate within the stator 170, but may rotate with the stator 170, as the elongated member 160 rotates within the cylinder 156.

In some embodiments, the connection member 170 may comprise a fork 172. The fork 172 may comprise openings 174 that may be operable to rotatably couple with a pin 173. The connection member 174 may rotate about the axis of pin 173.

In some embodiments, the system 100 may comprise a clamping fixture 180. The clamping fixture 180 may be operable to couple with the connection member 170 by the pin 173. The clamping fixture 180 is shown in further detail in FIG. 8, as described below.

Figure 8:
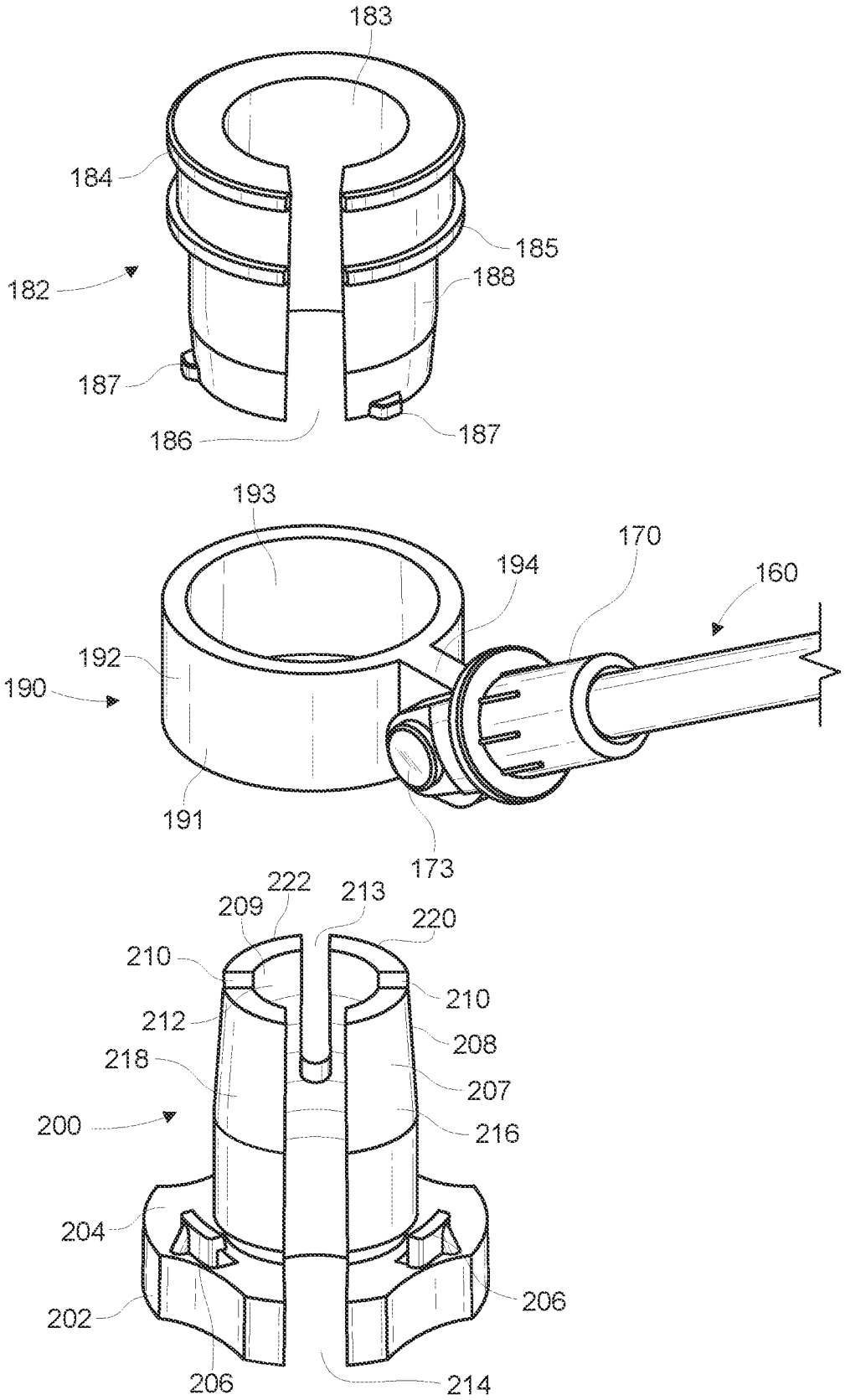
FIG. 8 is an illustration of an embodiment of an aspect of a golf swing training apparatus.

Referring now to FIG. 8, an exploded view of a clamping fixture 180 is shown. In some embodiments, the clamping fixture 180 may comprise a stator member and a rotating member. The stator member may comprise a first clamping member 200. The first clamping member 200 may comprise a base 202. The base 202 may comprise a plateau 204. The first clamping member 200 may comprise a cylindrical wall 207. The cylindrical wall 207 may comprise an outer surface 208 and an inner surface 209. The cylindrical wall 207 may extend from the base 202.

In some embodiments, the cylindrical wall 207 may comprise gaps 210, 211, and 213. The cylindrical wall 207 and the base may comprise a space 214. The cylindrical wall 207 may comprise a first section 216, a second section 218, a third section 220, and a fourth section 222, separated by gaps 210, 211, and 213 and by space 214, as shown in FIG. 8. The cylindrical wall 209 may comprise an inner surface 209 and an opening 212.

In some embodiments, the base 202 may comprise at least one locking receiver 206. In some embodiments, the at least one locking tab 206 may comprise at least a second locking receiver.

In some embodiments, the stator member of the clamp 180 may comprise a second clamping member 182. The second clamping member 182 may comprise a wall 188. The second clamping member may comprise an upper lip 184 and a lower lip 185. The wall 188 may comprise a space 187 and an opening 183. The second clamping member may comprise at least one locking tab 187. In some embodiments, the at least one locking tab 187 may comprise a second locking tab.

As mentioned above, the clamp 180 may comprise a rotating member, such as a rotating member 190. The rotating member 190 may comprise a wall 191 having an outer surface 192. The rotating member 190 may comprise an opening 193. The rotating member may comprise a stem 194. The stem 194 may be operable to be coupled with the fork 172. Pin 173 may be operable to pass through openings in the fork 172 and in the stem, thereby coupling the fork 172 to the stem 194. The fork 172 may be operable to rotate about the pin 173.

The first clamping member 200 may be operable to fit about a shaft. The shaft may pass through the opening 212, such the shaft is adjacent to the inner surface 209 of the first clamping member.

In some embodiments, the outer radius of the wall 207 at its largest point may be less than the inner radius of the second clamping member 182. In some embodiments, the radius of the lower lip 185 may be greater than the outer radius of the rotating member 190. In some embodiments, after a shaft has passed through the opening 209, the rotating member may be placed over the shaft and outer surface 208 of the wall 207. The shaft may then pass through the opening 183, with the second clamping member 182 at least partially passing through the opening 193 of the rotating member 190. The at least one locking tab 187 may be positioned and may be operable to engage with the at least one locking receiver. The at least one locking tab 187 may be locked into place by twisting at least one of the first clamping member 200 and the second clamping member 182, such that at least one of the first clamping member 200 and the second clamping member 182 rotates relative to the other and locks the at least on locking tab 187 at least partially under the at least one locking receiver 206.

In some embodiments, each of the first section 216, the second section 218, the third section 220, and the fourth section 222 may flex toward the center of the first clamping member 200 or away from the center of the first clamping member 200 in order to accommodate the size of shaft being used. In a similar way, the wall 188 of the second clamping member 182 may flex, thereby changing inner diameter of the second clamping member 182 in order to accommodate the outer diameter of the wall 207.

In some embodiments, the rotating member 190 may be prevented from translating vertically about the shaft by the base 202 and the lower lip 185. The lower lip 185 may have a diameter greater than that of at least the inner diameter of the rotating member 190.

In some embodiments, the rotating member 190 may be sized and configured to have an inner diameter greater than that of the outer diameter of the wall 188. The rotating member 190 may rotate about the axis of the first clamping member 200, the second clamping member 182, and the rotating member 190.

The first clamping member 200 may be operable to fit over a shaft, such as shaft 195, as shown in FIG. 7. The shaft 195 may comprise the shaft of a golf club, such as a putter, a wood, a fairway, a driver, an iron, a wedge, or a hybrid. In some embodiments, the clamp may be operable to be detachably coupled about a grip 197 of the shaft 195. In some embodiments, the clamp may be operable to be detachably coupled below the grip 197 of the shaft 195. Some shafts may comprise a conical shape, being wider at one end and narrower at a distal end and may have a linear decrease in shaft diameter. The clamping member 180 is operable to provide a tight fit over most golf club shafts.

A user may grip the shaft 195, such as the shaft of a golf club, by grip 197, while the shaft is coupled with the clamping member 180. Upon swing the shaft 195, a user may cause the clamping member and the coupled shaft 195 to rotate about pin 173. The shaft 195, along with the clamp 180, the stator 170 and the elongated member 160 may rotate about the axis of the elongated member 160, as shown in various figures by arrow 162. The shaft 195, along with the clamp 180, the stator 170 and the elongated member 160 may translate toward the mount 110 by a dynamic adjustment in length as the elongated member 160 moves within the cylinder 154, compressing the biasing member 156. The shaft 195, along with the clamp 180, the stator 170, the elongated member 160, and the arm 150 may rotate in all directions as the ball 152 rotates about axes in the x, y, and z planes. When the shaft 195 is not being used, the mounting collar 120 may be moved up and down the mount 110 to accommodate the height of multiple users by engaging first pedal 132*a* and second pedal 132*b* in order to disengage the first protrusion 136*a* and 136*b* from the first notch 112*a* and the second notch 112*b*, respectively, allowing the mounting collar 120, along with the shaft 195, the clamp 180, the stator 170 the elongated member 160 and the arm 150 to move or translate up and down the mount 110.

In some embodiments, the golf swing training apparatus 100 may comprise an electronic system. The electronic system may include a transceiver operable to transmit and receive information to/from an external source. The electronic system may comprise a central processor and a memory operably coupled to the transceiver. The electronic system may comprise multiple sensors operably coupled to the memory and to the processor, the sensors being operable to detect how many times a user has swung the shaft, how many times the target has been achieved and so forth. Such information may then be communicated, via the transceiver, to an external location, such as a server or a mobile device and analysis may be performed on any data produced.

The electronic system may comprise a speaker operable to communicate with a source via Bluetooth or other near field communication method to play music or coaching or other media. The electronic system may comprise a camera operable to record video and still images of the user.

Figure 9:
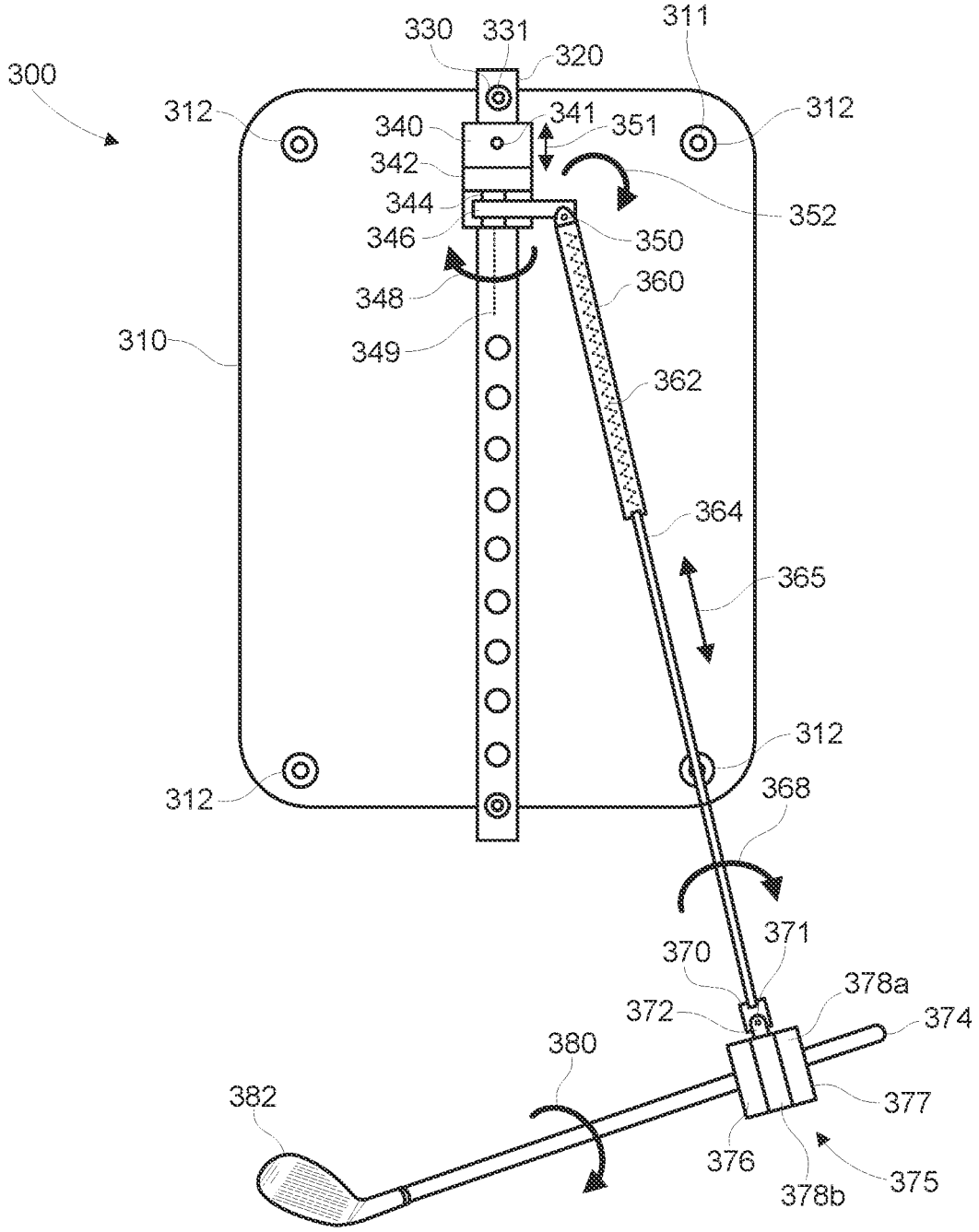
FIG. 9 is an illustration of an embodiment of a golf swing training apparatus.

Referring now to FIG. 9, some embodiments may comprise a golf swing training system 300. The golf-swing training system 300 may comprise a fixture 310. The fixture 310 may comprise a wall fixture. The fixture 310 may be operable to be detachably coupled to a secure base. In some embodiments the secure base may include a wall, a pole, a vehicle, a golf cart, or other base capable of supporting the fixture 310. The fixture 310 may comprise at least one opening 312. The at least one opening 312 may be sized and configured to accommodate a fastener 311. The fastener 311 may be operable to detachably couple the fixture 310 to the base.

In some embodiments, the system 300 may comprise a support 320. The support 320 may comprise a rigid member extending the length of the fixture 310. The support 320 may be detachably coupled to the fixture 310 via at least one fastener 331 passing through at least one opening 330, the at least one opening 330 being sized and configured to accommodate the fastener 331. The fastener 331 may comprise a screw, a bolt, a pin, or other fastener known in the art.

The system 300 may further comprise a mount 340. The mount 340 may comprise an arm 342 extending away from the support 320. The axial member 340 may further comprise an axle 344. The axle 344 may extend away from the arm 342. In some embodiments, the axle 344 may extend normal from the arm 342. In some embodiments the axle 344 may extend from the arm 342 at an acute angle or at an obtuse angle in any plane. The mount 340 may be detachably coupled to the support 320 by a fastener 341. The fastener 341 may comprise a pin or other fastener known in the art. The fastener 341 may be operable to pass through the mount 340 into one of the at least one opening 330 on the support 320. The height of the mount 340 may be adjusted according to a user's needs.

In some embodiments, the system 300 may further comprise a rotating arm 346. The axle 344 may be sized and configured to fit within an opening within the rotating arm 346, detachably coupling the rotating arm 346 to the axial member 340. The rotating arm 346 may rotate in the direction shown by arrow 348. In some embodiments, the rotating arm 346 may comprise a second axle 350. The second axle 350 may be located distally from the axle 344.

In some embodiments, the system 300 may comprise a tube 360. The tube 360 may comprise an opening sized and configured to accommodate the second axle 350. The tube 360 may be operable to rotate about the axle 350, as shown by arrow 352.

In some embodiments, the system 300 may comprise a biasing member 362. The biasing member 362 may be operable to compress and expand, as will be discussed herein below.

In some embodiments, the system 300 may comprise an elongated member 364. The elongated member 364 may be operable to move axially in the direction shown by the arrow 364. The elongated member 364 may slidably move within the tube 360 and may interface with the biasing member 362. In some embodiments, the elongated member 364 may be operable to rotate axially, as shown by arrow 368.

In some embodiments the elongated member 364 may comprise a connection 370. The connection 370 be fixedly coupled to the elongated member 364. The elongated member 364 may be operable to fit within the connection 370 such that the elongated member 364 may axially rotate within the connection 370. The connection 370 may comprise an opening located distally from the elongated member 364. The opening may be operable to receive a shaft, facilitating radial rotation of the elongated member 364, as discussed below.

In some embodiments, the system 300 may comprise a clamping fixture 375. The clamping fixture 375 may be operable to be rotationally and detachably fixed about a shaft, as will be discussed herein below. The clamping fixture 375 may comprise an arm 372. The arm 372 may comprise an opening operable to receive a shaft, such as shaft 371. The opening of the arm 372 may be operable to couple with the opening of the elongated member 364. The two openings may be joined together by shaft 371, and the elongated arm 364 may rotate about the shaft 371. The shaft 371 may comprise a pin, a bolt-nut combination, or other shaft known in the art.

In some embodiments, the clamping fixture 375 may comprise a first clamping member 376 and a second clamping member 377. The first clamping fixture 375 may be detachably coupled to a shaft, such as golf club shaft 374, by sliding the first clamping member 376 over a portion of shaft 374 having a smaller diameter.

The second clamping member 377 may be detachably coupled to the shaft 374 by placing the second clamping member 377 over the end of the shaft distally located from the club head 382. The second clamping member 377 may comprise a fixed portion 378*a*. The fixed portion 378*a* may be operable to hold the shaft 374. In some embodiments the fixed portion 378*a* may be tightened once in the desired position. The second clamping member may further comprise a rotational portion 378*b*. The arm 372 may be coupled to the rotational portion 378*b*. The rotational portion 378*b* may operably to rotate about the shaft 374.

The first clamping member 376 and the second clamping member 377 may be detachably coupled together such that the first clamping member 376 and the second clamping member 377 fixedly hold the shaft 374 while simultaneously allowing the shaft 374 to rotate about the axis of shaft 374, as shown by arrow 380.

In some embodiments, the golf swing training apparatus 300 may comprise an electronic system. The electronic system may include a transceiver operable to transmit and receive information to/from an external source. The electronic system may comprise a central processor and a memory operably coupled to the transceiver. The electronic system may comprise multiple sensors operably coupled to the memory and to the processor, the sensors being operable to detect how many times a user has swung the shaft, how many times the target has been achieved and so forth. Such information may then be communicated, via the transceiver, to an external location.

The electronic system may comprise a speaker operable to communicate with a source via Bluetooth or other near field communication method to play music or coaching or other media. The electronic system may comprise a camera operable to record video and still images of the user.

In some embodiments, the golf-swing training apparatus may further comprise a mat. The mat may extend on the ground or floor below the system 300. The mat may comprise a flexible material or a rigid material. The mat may comprise a target area where a user may aim at while using the apparatus 400. The mat may further comprise indicators, which may indicate where a user's feet should be placed during use. The mat may be part of any golf swing training system or apparatus described herein.

In some embodiments, the golf-swing apparatus 300 may comprise at least one arm. The at least one arm may extend up and outward from the arm The at least one arm may be raised to an elevation to match the backswing and or front swing of a user's golf swing. The at least one arm may be part of any golf swing training system or apparatus described herein.

Unless otherwise specified, the term "substantially" means within 5% or 10% of the value referred to or within manufacturing tolerances. Unless otherwise specified, the term "about" means within 5% or 10% of the value referred to or within manufacturing tolerances.

The conjunction "or" is inclusive.

The terms "first", "second", "third", etc. are used to distinguish respective elements and are not used to denote a particular order of those elements unless otherwise specified or order is explicitly described or required.

Numerous specific details are set forth to provide a thorough understanding of the claimed subject matter. However, those skilled in the art will understand that the claimed subject matter may be practiced without these specific details. In other instances, methods, apparatuses or systems that would be known by one of ordinary skill have not been described in detail so as not to obscure claimed subject matter.

The system or systems discussed are not limited to any particular hardware architecture or configuration.

Embodiments of the methods disclosed may be performed in the operation of such computing devices. The order of the blocks presented in the examples above can be varied—for example, blocks can be re-ordered, combined, and/or broken into sub-blocks. Certain blocks or processes can be performed in parallel.

The use of "adapted to" or "configured to" is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included are for ease of explanation only and are not meant to be limiting.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

That which is claimed is:

1. A golf swing training apparatus, comprising:

a mount operable to be coupled with a fixed object, the mount comprising a front section and a rear section, wherein the front section comprises a first side and a second side, the first side comprising at least one notch;

a mounting collar operable to be slidably coupled with the mount, the mounting collar comprising:

an outer side comprising a first pivoting member;

an inner side comprising a channel operable to slidably couple with the front section;

at least one lever pivotally coupled with the first side, the at least one lever comprising a first protrusion operable to detachably engage with the at least one notch; and a first pivot member on the outer side;

a second pivot member operable to be pivotally coupled with the first pivot member;

a tube coupled with the second pivot member, the tube comprising a cap detachably coupled to tube opposite the second pivot member, the cap comprising at least one opening;

a rod comprising a first end and a second end, the rod being telescopically coupled with the tube at the first end, the first end passing through the at least one opening;

a pivoting connection coupled with the second end of the rod; and a collar coupled to the pivoting connection, the collar comprising a stator and a rotator coupled to the stator, the collar being operable to detachably couple about a shaft.

2. The golf swing training apparatus of claim 1, wherein the second side comprises at least a second notch opposite the at least one notch;

the at least one notch comprises a first plurality of notches on the first side;

the at least a second notch comprises a second plurality of notches on the second side;

the mounting collar comprises a second lever comprising a second protrusion operable to couple with any of the at least a second notch and any one of the plurality of second notches;

the first protrusion is operable to couple with any of the at least one notch and any one of the plurality of second notches; and the first lever is coupled with the second lever via a biasing member.

3. The golf swing training apparatus of claim 2, wherein the first pivot member comprises a socket and wherein the second pivot member comprises a ball, the ball being operable to rotate within the socket, the ball having a greater diameter than the socket.

4. The golf swing training apparatus of claim 3, wherein the cap comprises at least one vent and wherein the rod is operable to rotate axially within the tube and is prevented from exiting the tube by the cap.

5. The golf swing training apparatus of claim 4, wherein the tube further comprises a biasing member within the tube, the biasing member operable to interface with the rod inside the tube.

6. The golf swing training apparatus of claim 5, wherein the clamp comprises at least one stator member and a rotating collar, wherein the at least one stator member is operable to be detachably coupled with a shaft and wherein the rotating collar is operable to be pivotally coupled with the rod and is operable to be detachably coupled about the at least one stator member, the at least one stator member comprising:

a first member; and a second member operable to be detachably couple to the first member about a shaft and wherein the rotating member is position about the first member and the second member and is operable to rotate about the first member and the second member.

7. The golf swing training apparatus of claim 6, wherein the stator member comprises a first member and a second member, wherein the first member and the second member are operable to be detachably coupled to each other about a shaft and within the rotating member, wherein the first member is partially positioned above the rotating member and the second member is partially positioned below the rotating member.

8. The golf swing training apparatus of claim 7, wherein the shaft is the shaft of a golf club.

9. A golf swing training apparatus, comprising:

a mount operable to couple with a fixed object;

a mounting collar operable to couple with the mount;

an arm operable to be pivotally coupled with the mounting collar;

a clamp pivotally coupled with the arm, wherein the clamp is operable to be clamped about a shaft, wherein the mount comprises a first side, wherein the first side comprises at least one notch, and wherein the mounting collar comprises at least one lever, the at least one lever being pivotally coupled with the first side, and wherein the at least one lever comprises a first protrusion operable to couple with the at least one notch.

10. The golf swing training apparatus of claim 9, wherein the mounting collar is slidably coupled with the mount and is operable to move to various positions on the mount.

11. The golf swing training apparatus of claim 9, wherein the mounting collar comprises a first pivoting member and the arm comprises a coupling pivoting member, wherein the first pivoting member and the coupling pivoting member are operable to be coupled together, the coupling pivoting member being operable to pivot and rotate within the first pivoting member.

12. The golf swing training apparatus of claim 11, wherein the first pivoting member comprises a socket and the coupling pivoting member comprises a ball sized and configured to fit within the socket, wherein the diameter of the ball is larger than the diameter of the socket.

13. The golf swing training apparatus of claim 9, wherein the arm comprises a first member and a second member having a first end and a second end, wherein the first member comprises a hollow axial center and wherein the second member is telescopically coupled with the first member, such that the second member is operable to translate into the hollow portion of the first member.

14. The golf swing training apparatus of claim 13, wherein the first member comprises a biasing member within the hollow axial, and wherein the first end of the second member is operable to interface with the biasing member within the hollow axial center of the first member.

15. The golf swing training apparatus of claim 9, wherein the arm comprises an end distal from the mounting collar, and wherein the arm, at the end distal from the mounting collar, is pivotally coupled with a clamp.

16. The golf swing training apparatus of claim 15, wherein the clamp comprises a stator member and a rotating collar, wherein the stator member is operable to be detachably coupled with a shaft and wherein the rotating collar is operable to be pivotally coupled with the arm and is operable to be detachably coupled about the stator member.

17. The golf swing training apparatus of claim 16, wherein the stator member comprises a first member and a second member, wherein the first member and the second member are operable to be detachably coupled to each other about a shaft and within the rotating member, wherein the first member is partially positioned above the rotating member and the second member is partially positioned below the rotating member.

18. The golf swing training apparatus of claim 17, wherein the shaft comprises a golf club shaft.

* * * * *